US009943159B1

(12) United States Patent
Novikova

(10) Patent No.: US 9,943,159 B1
(45) Date of Patent: Apr. 17, 2018

(54) HANDS-FREE, REFILLABLE, SKIN OINTMENT APPLICATOR

(71) Applicant: Yelena Novikova, New York City, NY (US)

(72) Inventor: Yelena Novikova, New York City, NY (US)

( * ) Notice: Subject to any disclaimer, the term of this patent is extended or adjusted under 35 U.S.C. 154(b) by 105 days.

(21) Appl. No.: 15/158,496

(22) Filed: May 18, 2016

Related U.S. Application Data

(60) Provisional application No. 62/162,945, filed on May 18, 2015.

(51) Int. Cl.

| | |
|---|---|
| ***A45F 5/00*** | (2006.01) |
| ***A45D 40/22*** | (2006.01) |
| ***B65D 43/16*** | (2006.01) |
| ***B65D 43/26*** | (2006.01) |
| ***B65D 43/22*** | (2006.01) |
| ***A44C 5/00*** | (2006.01) |

(52) U.S. Cl.
CPC ..... *A45D 40/22* (2013.01); *A44C 5/0007* (2013.01); *A44C 5/0053* (2013.01); *A45F 5/00* (2013.01); *B65D 43/162* (2013.01); *B65D 43/22* (2013.01); *B65D 43/26* (2013.01); *A45F 2005/008* (2013.01); *B65D 2543/00833* (2013.01)

(58) Field of Classification Search
CPC .... A45F 2005/008; A45F 5/00; A44C 5/0007; A44C 5/003
USPC ..... 224/183, 182, 165, 196, 219
See application file for complete search history.

(56) References Cited

U.S. PATENT DOCUMENTS

| | | | | |
|---|---|---|---|---|
| 1,486,178 A * | 3/1924 | Antelmi | ..... | A45C 11/22 224/221 |
| 1,631,371 A * | 6/1927 | Greubel | ..... | A45C 11/22 206/259 |
| 3,202,331 A * | 8/1965 | McKinstrie | ..... | B63C 11/02 224/221 |

(Continued)

FOREIGN PATENT DOCUMENTS

| | | |
|---|---|---|
| GB | 2412567 B | 2/2006 |
| WO | WO-2009/080845 | 7/2009 |

OTHER PUBLICATIONS

US URL: https://www.staples.com/velcro-3-4-x-1-2-hook-to-hook-fastener-clear-72-pack/product_VEK91389. Title:Velcro® ¾" × ½" Hook to Hook Fastener, Clear, 72/Pack.

(Continued)

*Primary Examiner* — Brian D Nash
(74) *Attorney, Agent, or Firm* — Robert W. J. Usher

(57) ABSTRACT

A hands-free, skin ointment applicator or comestible holder wearable on the wrist area of a user has a wristband; an open-topped container with an ointment or comestible mound upstanding from the open top; a recessed cover integrally joined to the container for hands-free movement between closed and open positions protectively receiving the mound in the recess and exposing the upstanding mound for application to the user's face or mouth; respectively; magnets or Velcro for retaining the cover closed; and, a cover release tab for gripping by the user's mouth to pull the cover open. A web hinge joining the cover and container, guiding the cover to the closed position. A refill cartridge carrying the mound is mounted, releasably, in the container.

24 Claims, 23 Drawing Sheets

(56) References Cited

U.S. PATENT DOCUMENTS 3,680,751 A * 8/1972 Ten Brook ..... A44C 5/003 206/540
4,387,838 A * 6/1983 Jackson ..... A41D 19/0027 2/160
4,536,889 A * 8/1985 Taylor ..... A44C 5/0046 2/160
4,639,947 A * 2/1987 Lanscioni ..... A41D 19/01594 2/161.5
4,659,000 A * 4/1987 Sales ..... A45F 5/02 224/269
4,736,876 A * 4/1988 Kriss ..... A45C 1/04 222/175
4,761,835 A * 8/1988 Chen ..... A41D 19/0027 2/160
4,781,315 A 11/1988 Nordskog
5,003,637 A * 4/1991 Lonon ..... A41D 19/0024 2/160
5,035,000 A * 7/1991 Matthias ..... A41B 7/00 2/123
5,127,545 A * 7/1992 French ..... A45F 5/00 221/102
D399,605 S 10/1998 Metcalf
5,899,369 A 5/1999 Macripo
6,173,866 B1 * 1/2001 Taylor, Jr. ..... A45F 3/20 222/175
D560,134 S 1/2008 Chen
7,316,332 B2 1/2008 Powers et al.
D571,684 S 6/2008 Kim
8,474,668 B2 * 7/2013 Toman ..... A45F 5/00 224/219
D710,739 S * 8/2014 Miller ..... D11/5
8,894,314 B2 11/2014 Morrow et al.
9,516,930 B2 * 12/2016 Izkovitz ..... A44C 9/0069
2002/0162355 A1 * 11/2002 Andersen ..... A44C 5/003 63/18
2005/0022554 A1 2/2005 Davidson et al.
2006/0126444 A1 * 6/2006 Ellner ..... G04B 37/127 368/246
2007/0088298 A1 * 4/2007 Powers ..... A45D 34/00 604/310
2008/0067193 A1 * 3/2008 Powers ..... A45D 34/00 222/175
2011/0167536 A1 7/2011 Kellerhalls
2014/0263311 A1 * 9/2014 Di Tata ..... B65D 25/20 220/17.1
2015/0253736 A1 * 9/2015 Watterson ..... G04G 21/04 368/10

OTHER PUBLICATIONS

Publn date unknown—believed prior art.

* cited by examiner

HANDS-FREE, REFILLABLE, SKIN OINTMENT APPLICATOR

RELATED APPLICATION

Priority is claimed from my provisional application No. 62/162,945 filed May 18, 2015, the disclosure of which is incorporated herein by reference.

FIELD OF THE INVENTION

The invention relates to a hands-free, refillable, skin ointment applicator adapted to be worn on a user's wrist to enable them to rub skin ointment such as lip balm or sun screen on their face without needing to use their hands. The invention also relates to a hands-free comestible holder for dipping the comestible in the user's mouth.

BACKGROUND OF THE INVENTION

Many people need to apply an immediately protective skin ointment to their faces during active participation in athletic or sporting activities when they do not have a free hand, are reluctant or unable to remove bulky and cumbersome mittens, as when skiing or in very cold weather, while others, such as small children or geriatrics, often possess very poor manipulative skills.

Thus, there exists a need for a wearable skin ointment applicator which can be employed to rub skin ointment onto the user's face without hand/finger involvement.

U.S. Pat. No. 4,781,315 to Nordskog teaches a container with a removable cover for small articles such as coins, sun screen, lip balm or cosmetics, adapted to be attached to a user's wristband for availability, when worn, at all times.

However, removing the cover to enable access and, actually accessing the contents, cannot be achieved hands-free, clearly requiring manipulation of the cover by the user's fingers. Furthermore, following cover removal, user's fingers must then be employed to remove the contents from the container for subsequent application to facial skin.

SUMMARY OF THE INVENTION

It is one object of the invention to provide a wearable skin ointment applicator for hands-free application by users.

It is another object of the invention to provide a wearable skin ointment applicator which can be easily refilled by the user.

According to one aspect, the invention provides a skin ointment applicator wearable on the wrist area of a user and comprising a container retaining a reservoir of ointment as a stable mound upstanding from an open top, exposed for rubbing on the user's skin by relative movement of the wrist across the face; a cover integrally connected to the container for hands-free movement between a closed position, protectively covering the ointment mound and, an open position, exposing the ointment mound for rubbing access, respectively; means for retaining the cover in the closed position; and, a tab extending from the cover for gripping by the user's mouth to pull the cover away from the base to the open position.

Preferably, guide means are provided on the applicator to maintain closing alignment of the cover and open top during closing movement.

In one embodiment, the guide means comprises a web hinge integrally joining the cover and container. In another embodiment, the guide means comprises a pair of magnets positioned, respectively, on the cover and container to be brought into proximity in the closed position.

In the latter embodiment, the magnets also comprise the means for retaining the cover in the closed position.

Preferably, the magnets are received and retained in respective pockets formed in corresponding locations in the cover and container respectively.

In another embodiment, the applicator comprises a velcro wristband and the tab is velcro, inter-engagement of the tab and wristband constituting the means for retaining the cover in the closed position.

Preferably, the container comprises a base and, a refill comprising an ointment cartridge mountable, for user release, on the base.

It is also preferred that, the ointment cartridge comprises an ointment supporting platform having one or more ointment retaining protuberances upstanding from an upper face thereof embedded in the ointment mound for anchoring the mound of ointment on the platform during application by rubbing and, complementary mounting means on the base and cartridge for releasably mounting the cartridge on the base to enable user refill.

The ointment retaining protuberances may comprise a series of segmental plates extending spaced apart in opposed relation, across a rubbing direction.

In one embodiment, the means for mounting the refill cartridge for manual release on the base comprises resilient latching legs with respective finger pieces at upper ends and latching feet at lower ends and pivotally connected intermediate their ends to the perimeter of the platform, the base comprising a bottom wall and a retaining wall upstanding around a perimeter of the bottom wall and formed with vertical, latching leg receiving slots, such that, with the latching legs aligned with the respective slots, the cartridge can be pushed down onto the base wall with the legs sliding down the slots until the latching feet engage a perimeter of the bottom wall of the base in a snap action. The cartridge can be released from the bottom wall of the base by manually squeezing the finger pieces together thereby to rock (pivot) the latching feet apart out of engagement or, at least reduce the force of their engagement, with the bottom wall portion, releasing the cartridge to enable refill to be pulled manually out of the container base by the finger pieces over-riding any residual retention force from the feet, facilitated by forming the feet with a rounded surface of engagement.

In another embodiment, latching legs depend from the perimeter of the cartridge platform and have latching feet at lower ends, the base bottom wall is formed with a series of through sockets at aligned locations and a latching ledge juts out horizontally from an inner side wall of each socket intermediate the socket ends for latching engagement with outer catch surfaces on the respective legs. Release of the legs and cartridge are effected by manually urging the feet apart /outwards so as to disengage from the respective latching ledges.

The tab may be formed by a flexible strip of velcro or be relatively stiff and formed by a land of the cover. Preferably, the land contains a magnet receiving pocket and the tab is a fin upstanding therefrom.

An ointment retaining wall may upstand around the perimeter of the platform.

It will be appreciated that references to the wrist include the forearm and that the applicator may, of course, be worn over protective outer garments.

The applicator may be used to dispense other consumable products such as non flowable comestibles, including medicines, candy, especially hot pour products that cool or can be otherwise molded into a mound.

BRIEF DESCRIPTION OF THE DRAWINGS

In order that the invention may be readily understood, specific embodiments thereof will now be described by way of example only and with reference to the accompanying drawings in which.

PARTICULAR DESCRIPTION

Figure 1:
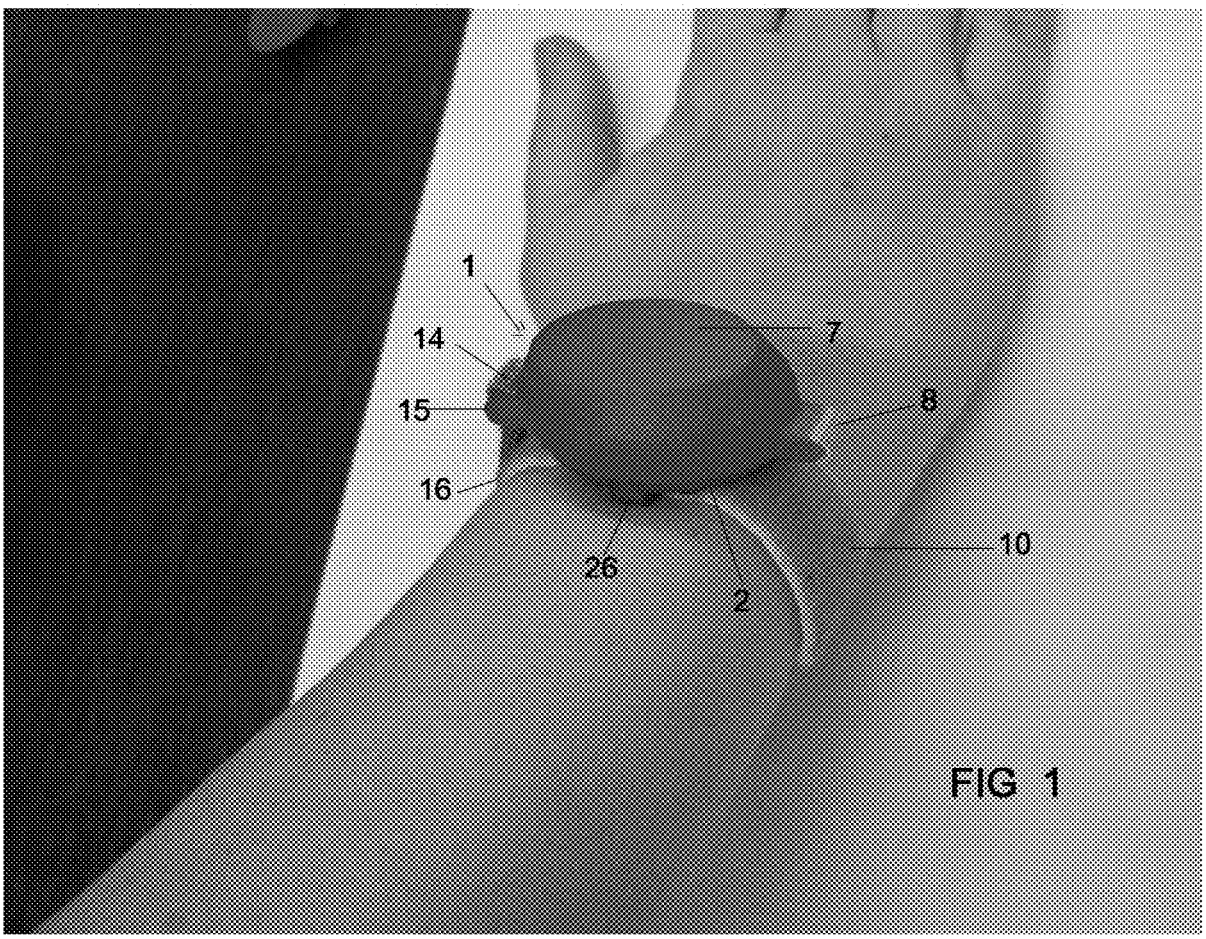
FIG. 1 is a perspective view from above of a first embodiment of applicator with a Velcro wristband worn on a user's wrist.
Figure 2:
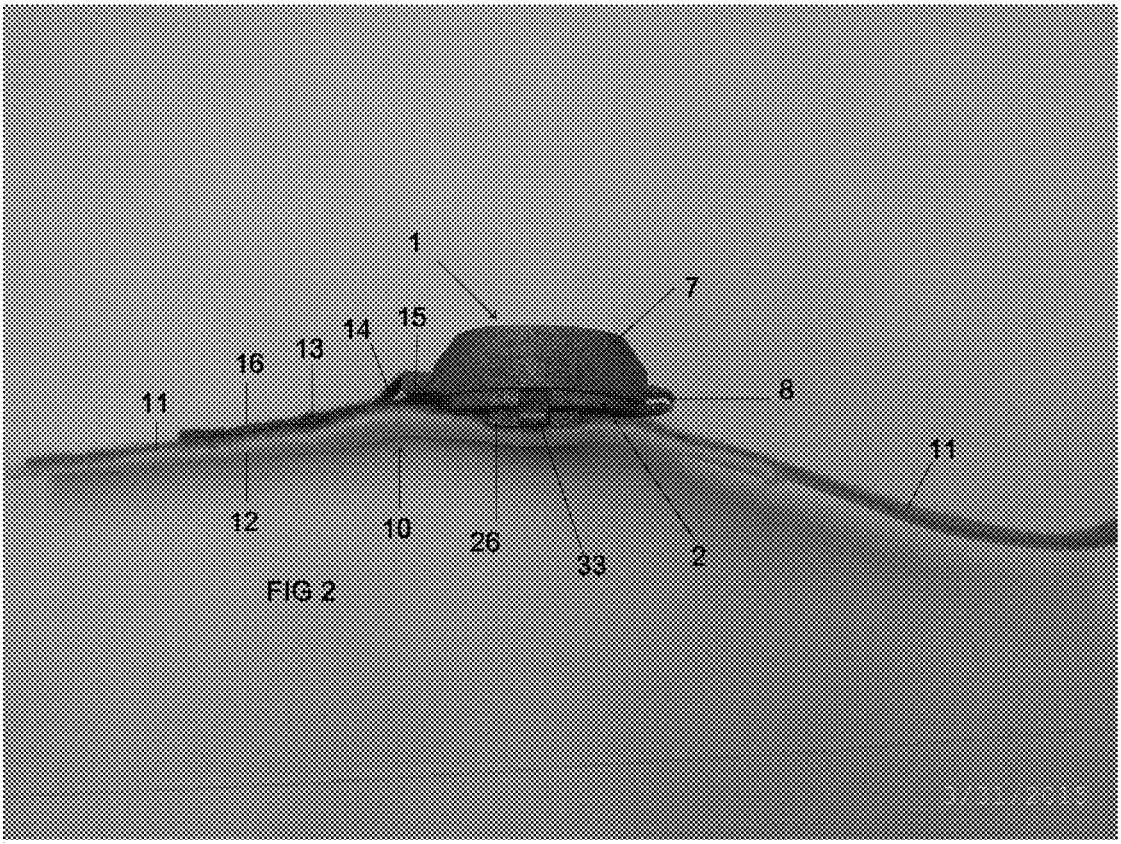
FIG. 2 is a perspective view of one side of the applicator of FIG. 1.
Figure 3:
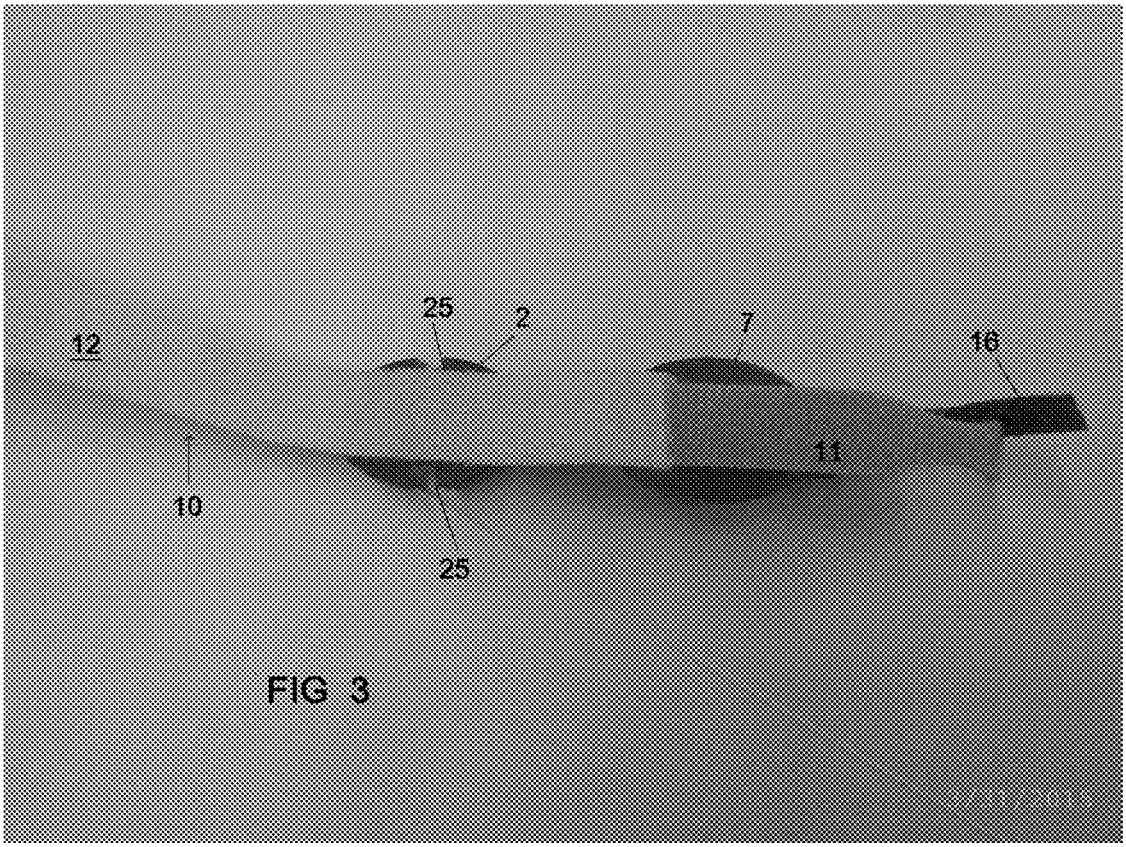
FIG. 3 is a perspective view of the underside of the applicator of FIG. 1 without refill.

As shown particularly in FIGS. 1-7, a skin ointment applicator 1 comprises a open topped container 2 retaining a reservoir of ointment as a stable mound 3 upstanding from the open top 5, exposed for rubbing on the user's skin; a movable cover 7, recessed for receiving and protectively covering the ointment mound 3 when closed and integrally joined at one end to the container 2 by a web hinge 8; and, a Velcro wristband/strap assembly 10.

The wristband 10 comprises a central strip 11 of double-sided velcro, a lower, comfort , lining strip 12 of one-sided velcro having an upper, active side adhered to a lower side of the central strip 11. An upper strip 13 of double sided Velcro has one end portion 14 looped through an eye structure 15, integrally formed with a free end of the cover, and bent back to adhere to itself so as to be fastened to the free end of the cover 7 and with the other end portion 16 adhered, releasably, to the upper side of the central strip 11 forming a tab.

Figure 4:
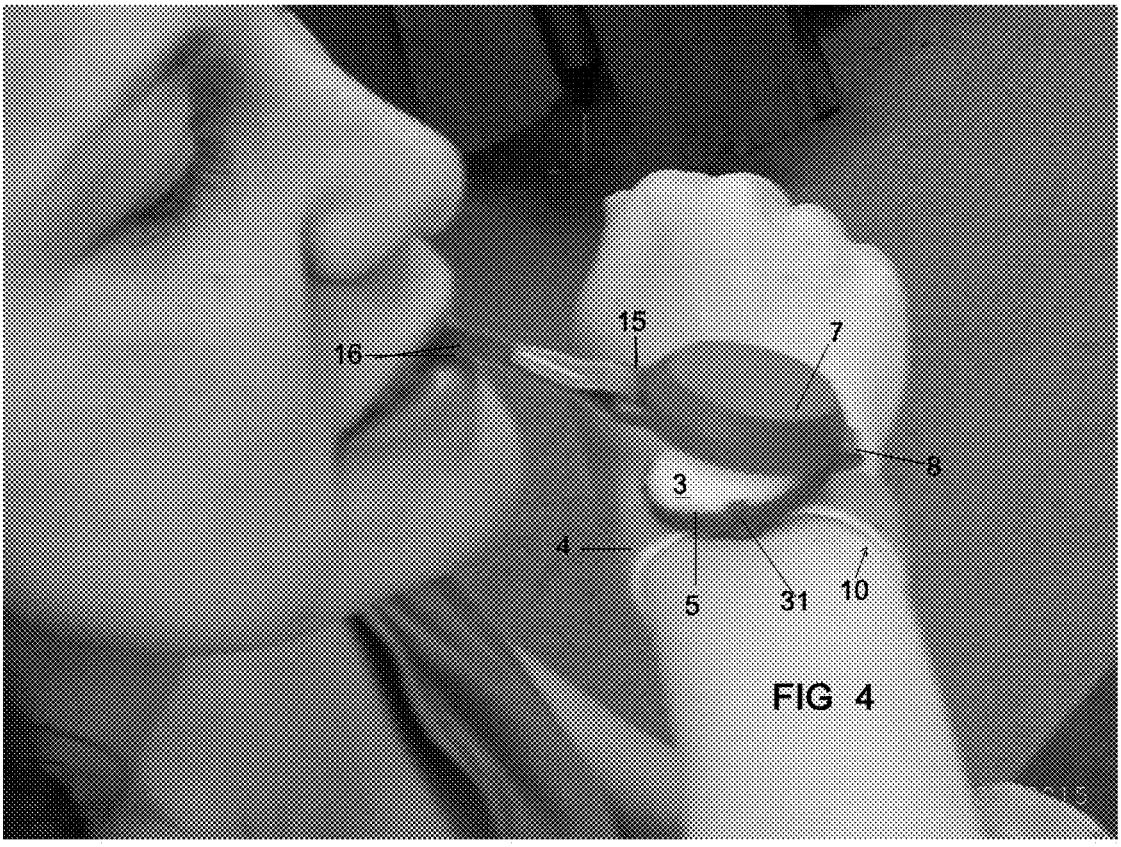
FIG. 4 is a perspective view showing initial release/removal of the cover by the teeth of a user.
Figure 5:
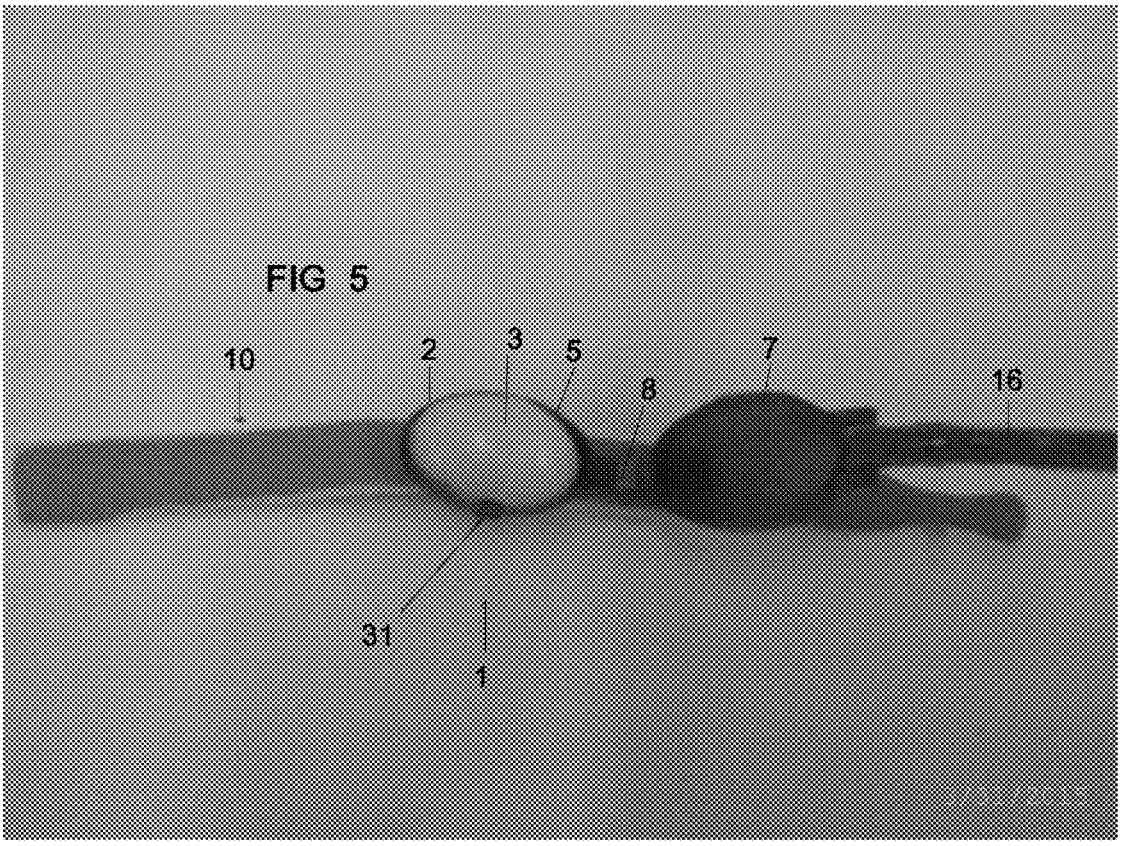
FIG. 5 is a perspective view of the top of the fully open applicator applicator.
Figure 6:
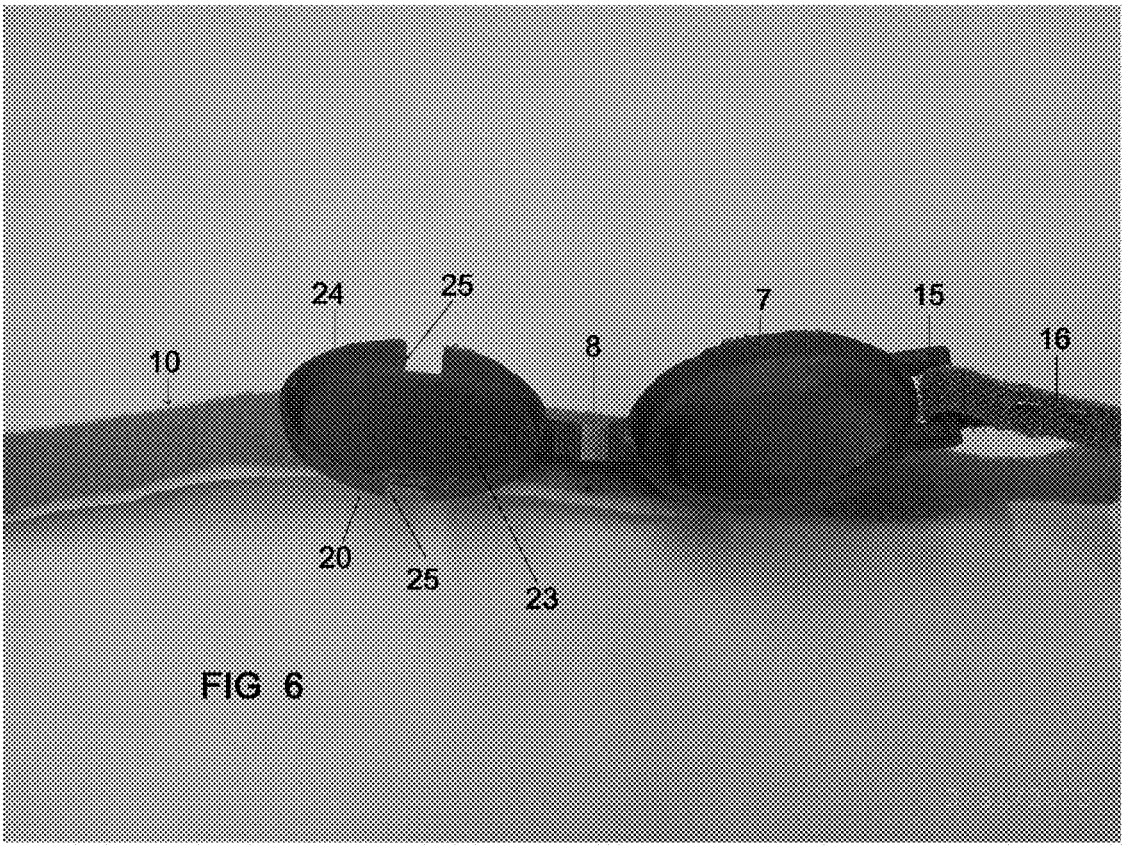
FIG. 6 is a perspective view of the top of the open applicator without a refill.

As shown in FIG. 4, the user can release the end portion 16 from the central strip 11 by pulling with their teeth, to raise the cover 7 to an open position exposing the mound 3 extending out from the container top for rubbing application to their skin. After ointment application, the cover 7 can be closed simply by pushing with the lips or chin and is guided back over the open tp 5 by the web hinge 8 and the Velcro end portion pressed back into adherence with the central strip 11, securing the cover in the closed position, protectively covering the ointment mound 3.

More particularly, the container comprises a base member 20 and a refill 21 mounted, releasably, on the base member.

The base member 20 comprises a flat bottom wall 23 around the periphery of which upstands a retaining wall 24 formed with a pair of vertical, slots 25 on respective opposite sided of the base member. A rectangular section, sleeve-like conduit 26 is formed integrally with the underside of the bottom wall 23 and threadingly receives and locates a medial portion of the central Velcro strip 11 to mount the base member on the strip, with the lower, one-sided, comfort strip 12 extending under the conduit also adhering to the strip 11.

Figure 7:
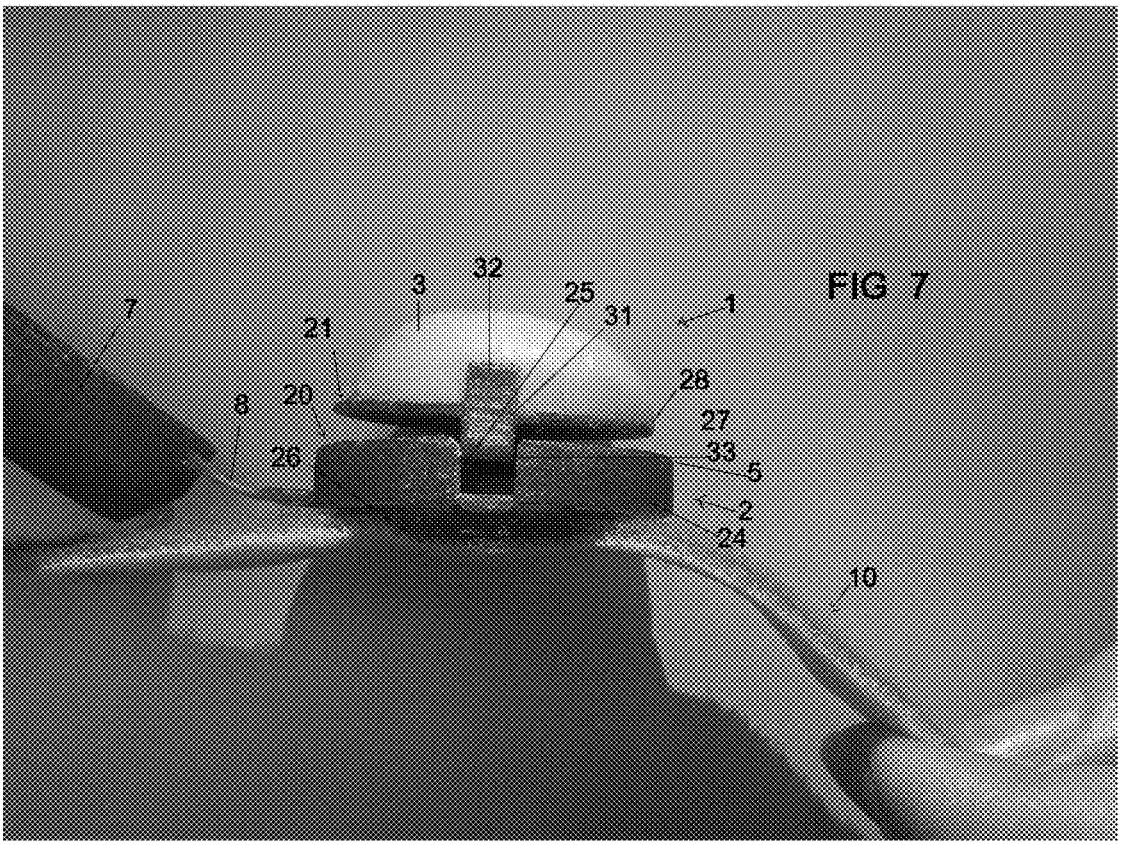
FIG. 7 is a perspective view from one side showing the refill aligned for mounting on the container base with the latching leg registered in a respective one of two leg receiving slots in respective opposite sides the upstanding base wall.
Figure 8:
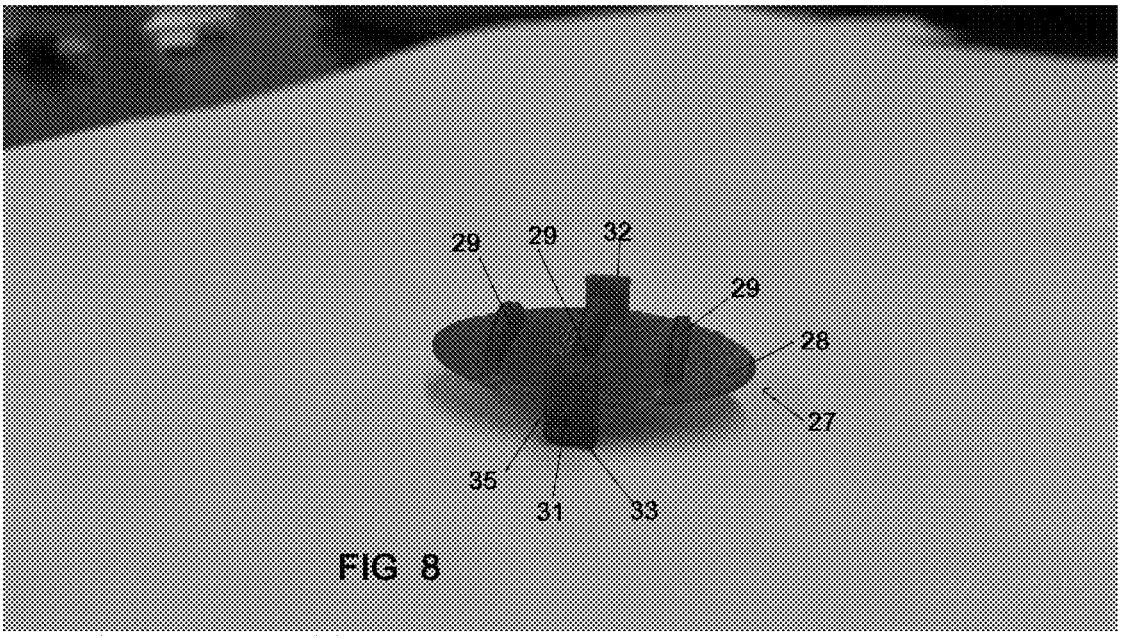
FIG. 8 is a perspective view of the upperside of an empty refill cartridge/carrier.
Figure 9:
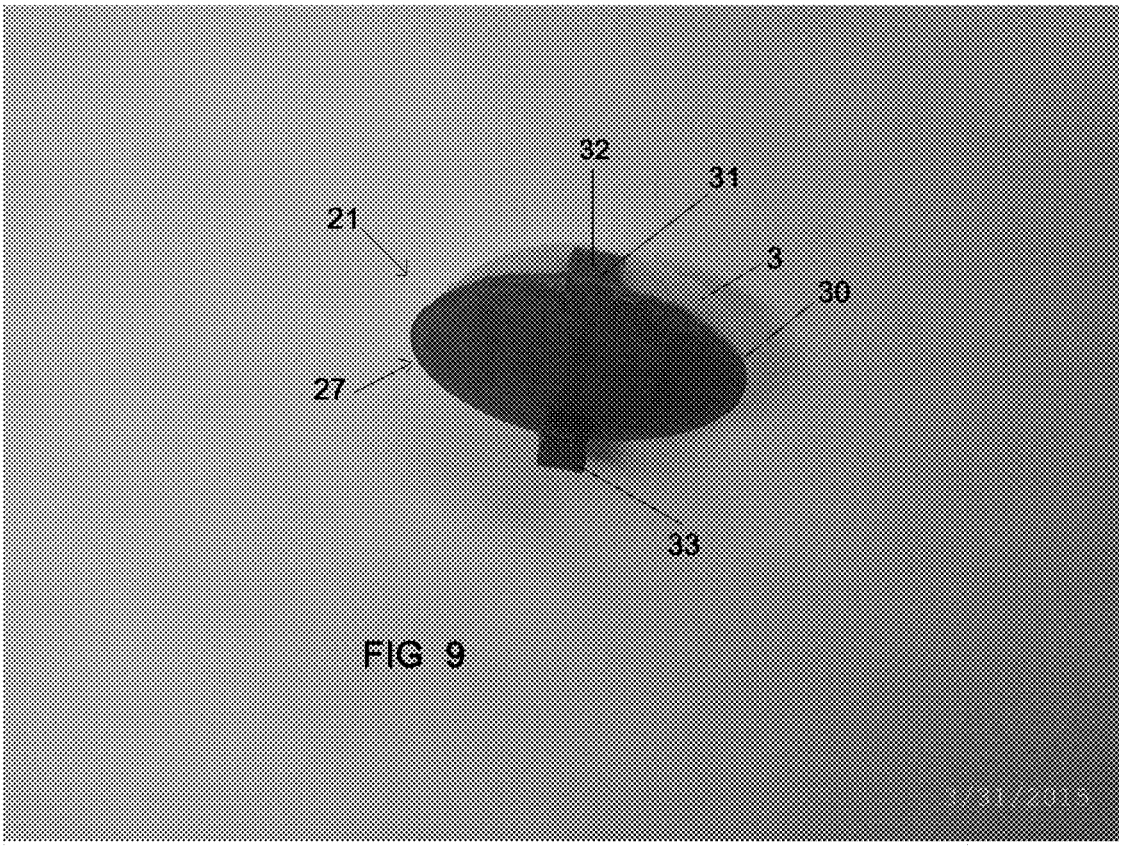
FIG. 9 is a perspective view of the underside of a refill cartridge loaded with an ointment mound.
Figure 10:
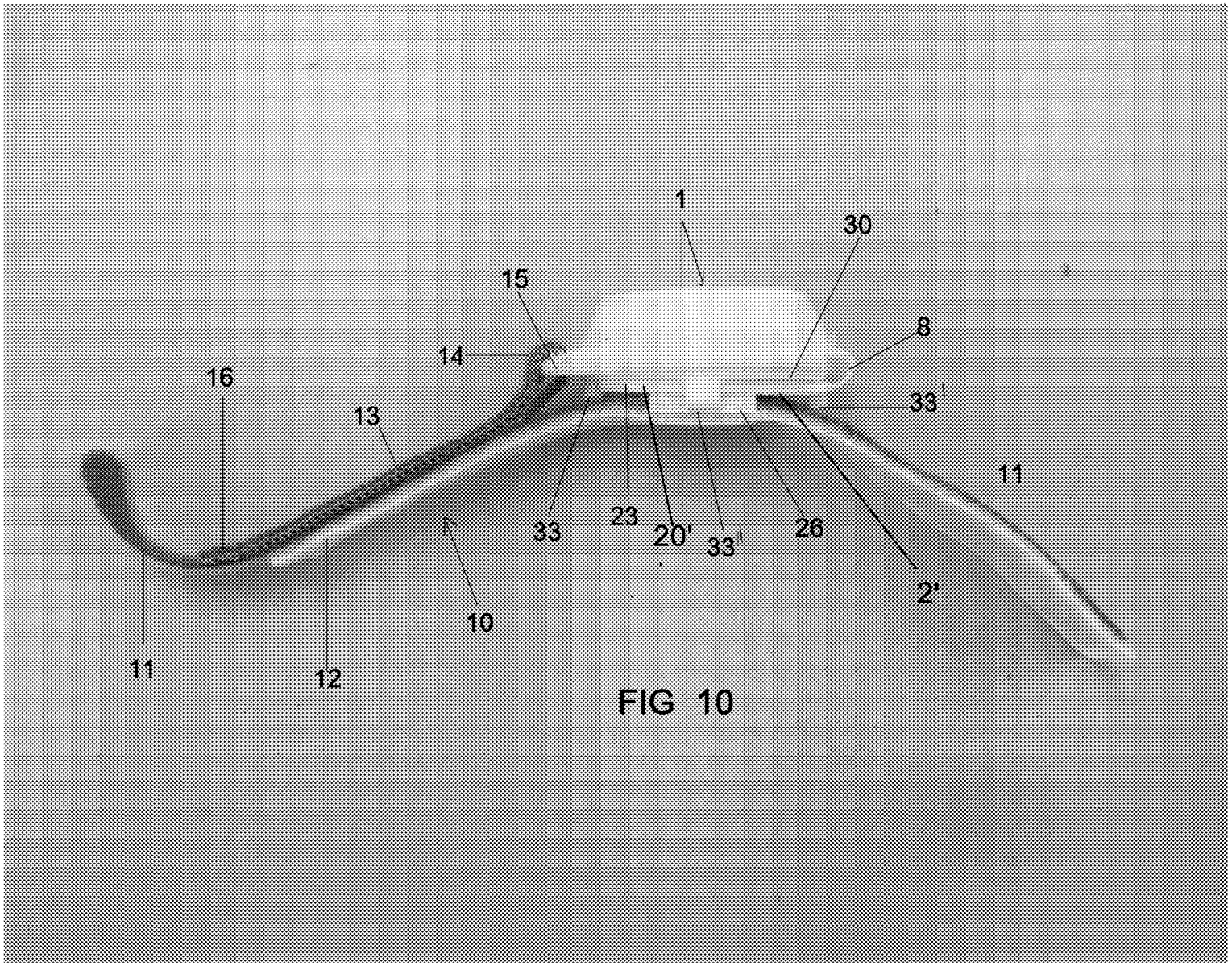
FIG. 10 is a perspective view of one side of a second embodiment in closed position on a user's wrist.
Figure 11:
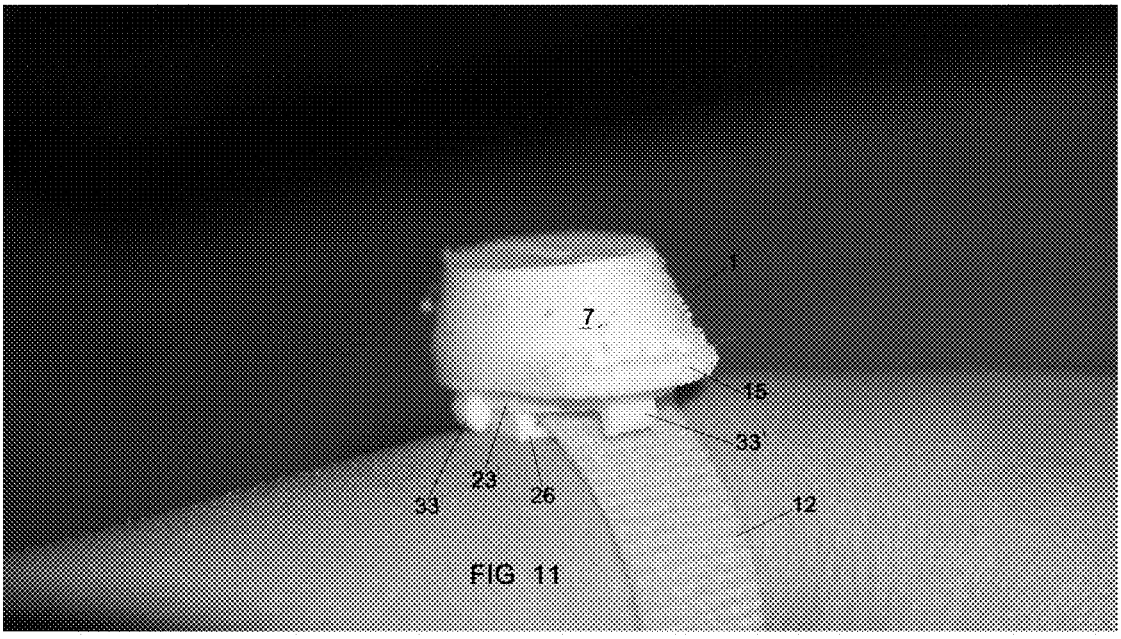
FIG. 11 is an end view of the second embodiment, (with only a single strip of the velcro wristband shown)
Figure 12:
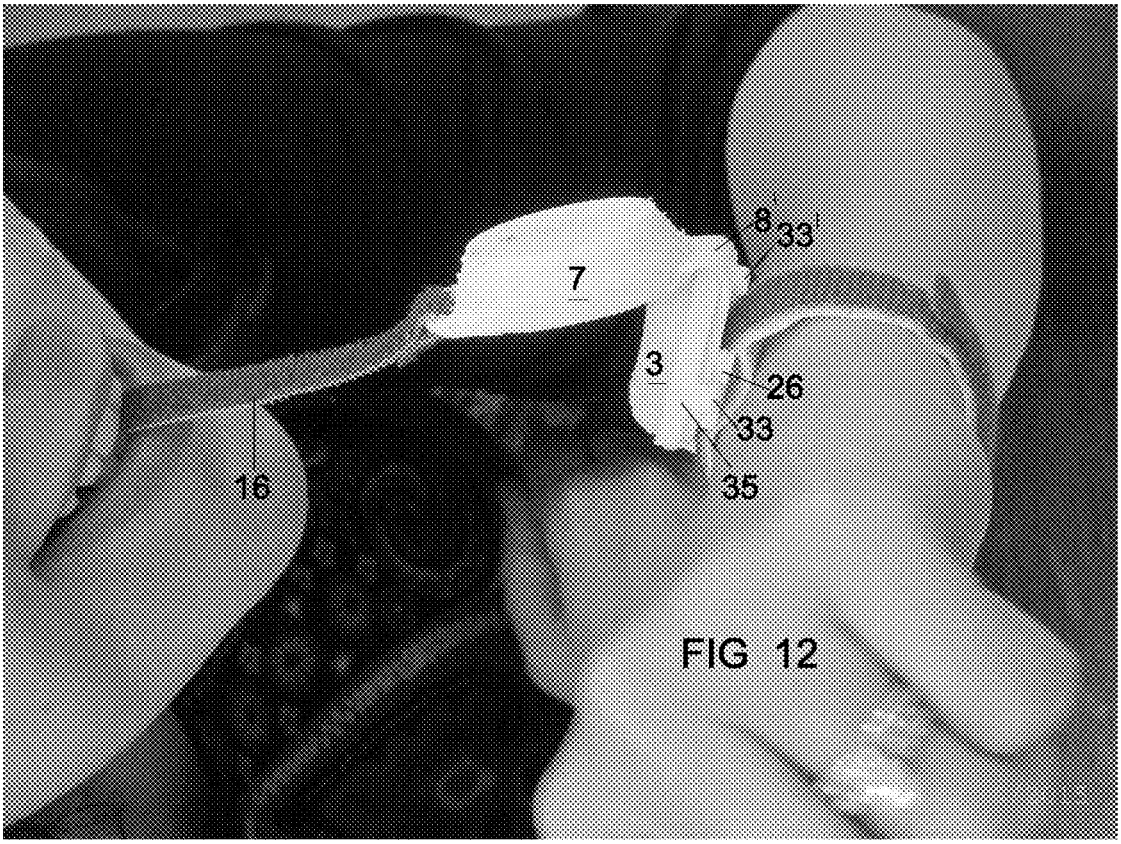
FIG. 12 is a perspective view of the second embodiment showing initial release/removal of the cover by the teeth of a user.
Figure 13:
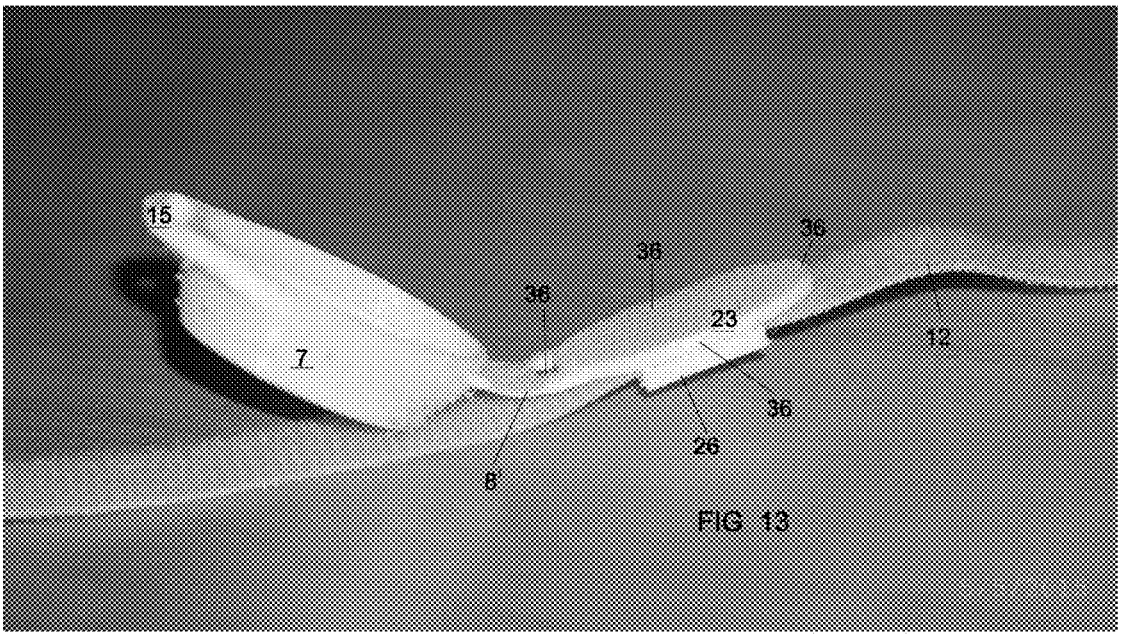
FIG. 13 is a perspective view of the second embodiment open and with the refill omitted (and only a single strip of velcro wristband shown)
Figure 14:
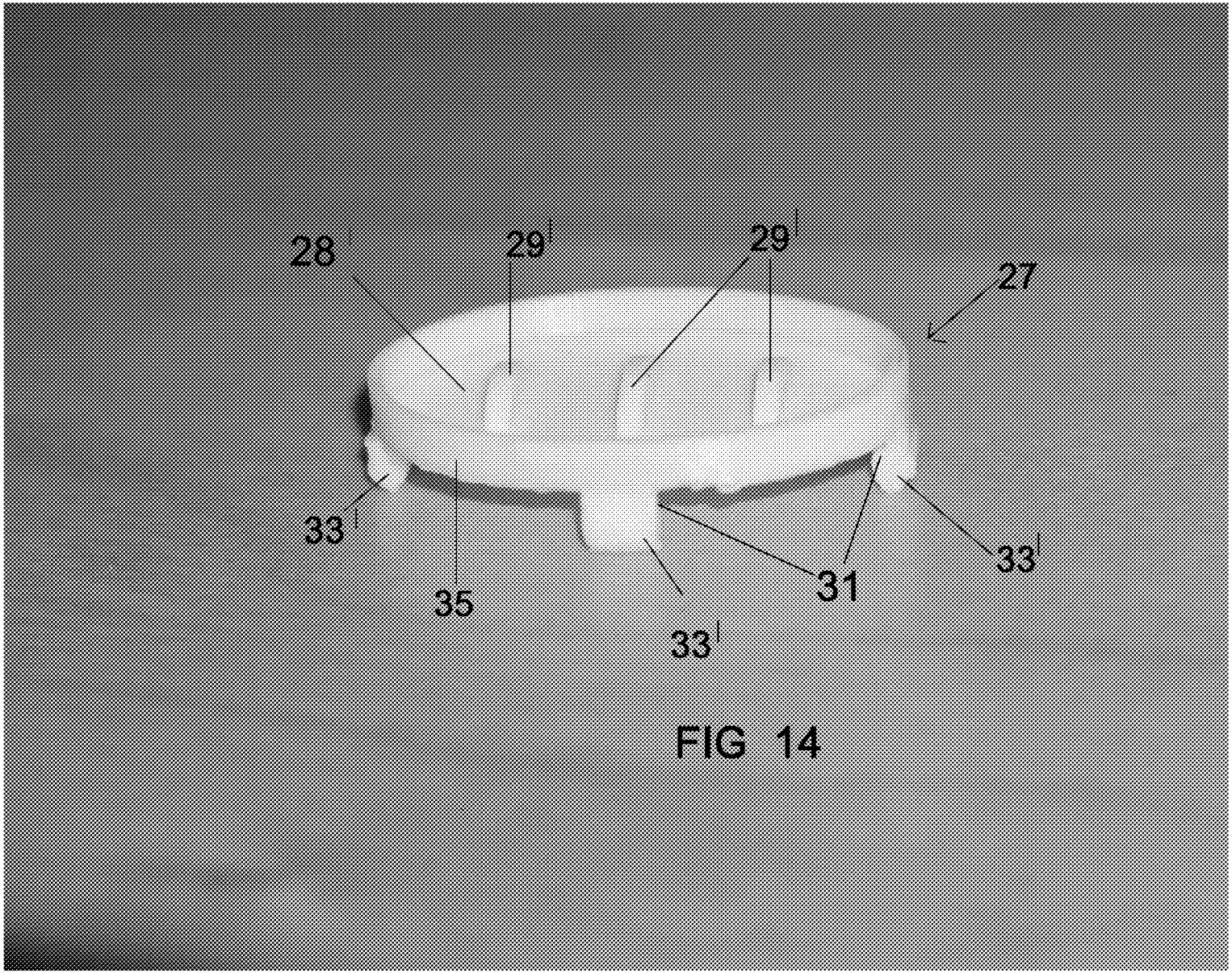
FIG. 14 is a perspective view of the top and one side the modified cartridge of the second embodiment.
Figure 15:
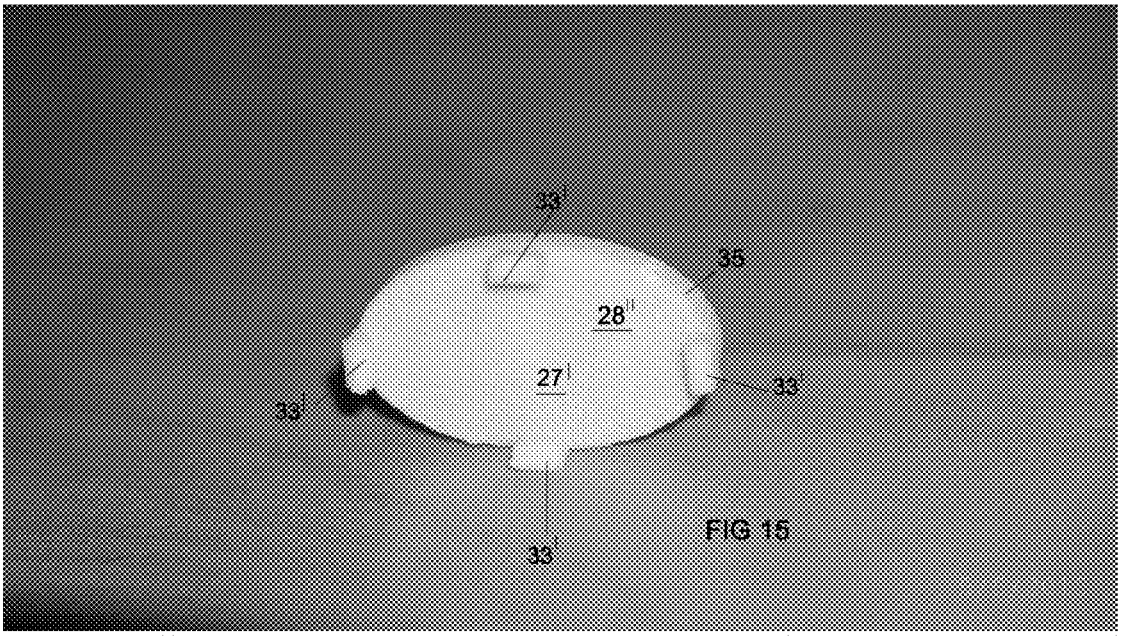
FIG. 15 is a perspective view of the underside of the modified cartridge of the second embodiment.

As shown particularly in FIGS. 7 to 9, the refill 21 comprises a one-piece ointment cartridge 27 with an ointment supporting platform 28 having three segmental anchoring fins 29 extending there-across, upstanding from an upper, ointment bearing face 30 in spaced apart, face to face relation, preferably, transversely of a rubbing direction, for maintaining maximum ointment mound stability. As clear from a comparison of FIG. 8 and FIG. 5, 7 or 9, the fins are embedded in the ointment mound 3 to anchor the mound on the platform 28 during rubbing application to the skin.

The refill 21 comprises a pair of resilient latching legs 31 with respective finger pieces 32 and (cylindrical) latching feet 33 formed at upper and lower end portions, respectively, and integrally, pivotally connected at a location 35 intermediate their ends to the perimeter of the platform 28 . The refill can be mounted on the base member by registering the latching legs 31 in the respective slots 25 on the base member and pushing the cartridge down onto the bottom wall 23 with the legs sliding down the slots until the latching feet engage the periphery of the bottom wall 23 in a snap action. The cartridge can be manually released from the base member by a squeeze and pull action—manually squeezing the finger pieces 32 together to rock the latching feet 33 apart, out of engagement/or at least reduce their engagement with the bottom wall, releasing the cartridge, and pulling the finger pieces upward thereby removing the refill from the container base.

The flat top surface of the cover facilitates mounting a personal logo, portrait, or flat, solid state watch thereon as chosen by a user In additional embodiments, for ease of understanding, elements identical to the first embodiment are indicated by the same reference numerals while modified elements are indicated by primed reference numerals.

In the second embodiment, shown in FIGS. 10 to 15, the principal modifications concern the structure of the container 2' in that the retaining wall (24) is omitted from the base member 20' so that the upper surface 23' is essentially flat and, instead, a retaining side wall 35 upstands from the entire perimeter of the platform 28' of the cartridge 27'. The cartridge has four, equi-spaced, latching legs 31', (without finger pieces), which only depend from the periphery of the cartridge platform, (not above it), terminating in latching feet 33' which clip, releasably over the periphery of the base at edge portions 36 (FIG. 13) with one leg passing through an aperture in the web hinge 8'

The base member can be made of a more flexible plastic material to permit easier release of the cartridge legs therefrom.

As the finger pieces have been omitted, (for example, to eliminate upstanding spigot structures), to release/de-mount the cartridge from the base member, the user must urge the latching feet apart using a suitable tool or their finger nails.

In other material respects, the structure and function are materially similar to the first embodiment In the third embodiment, shown in FIGS. 16 to 22, for improved safety and comfort when worn, the applicator 1", except for a cartridge of hard plastic, is made of a relative soft, rubber-like, material enabling the wrist band 10' to be integrally formed with the base member 20". The guide means comprises a pair of magnets 39 and 40, positioned, in respective pockets 41 and 42, formed in corresponding laterally extending lands 43 and 44, formed on the cover 7" and base member 20", respectively, to extend transversely of the strap 10", aligned to be brought into proximity in the closed position (FIGS. 16 and 22), thereby also to secure the cover closed. The cover opens to a position extending transversely, clear of the wrist band, instead of overlying the wrist band, as in prior embodiments.

The bottom wall 23", (FIGS. 19 and 20), is formed with four through-sockets 46 each having a latching ledge 47 jutting out horizontally, intermediate upper and lower ends which engages with a respective latching foot 33' of the cartridge 27', which is identical to that of the second embodiment.

In the latter embodiment, the magnets also comprise the means for retaining the cover in the closed position.

Figure 16:
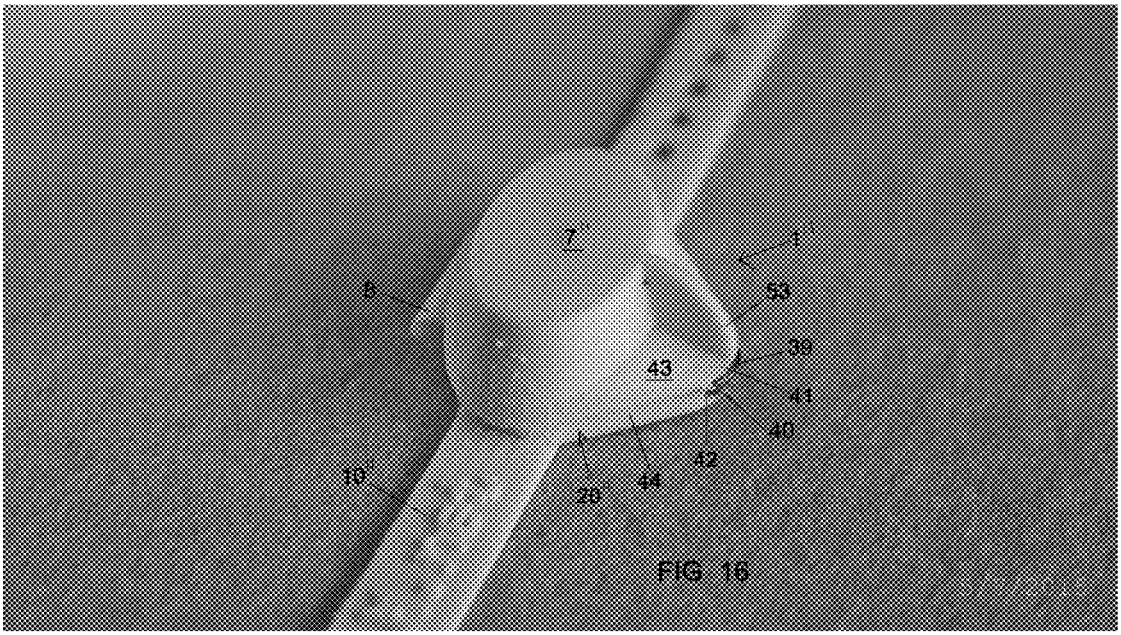
FIG. 16 is a perspective view of the top and one side of a third embodiment in closed position.
Figure 17:
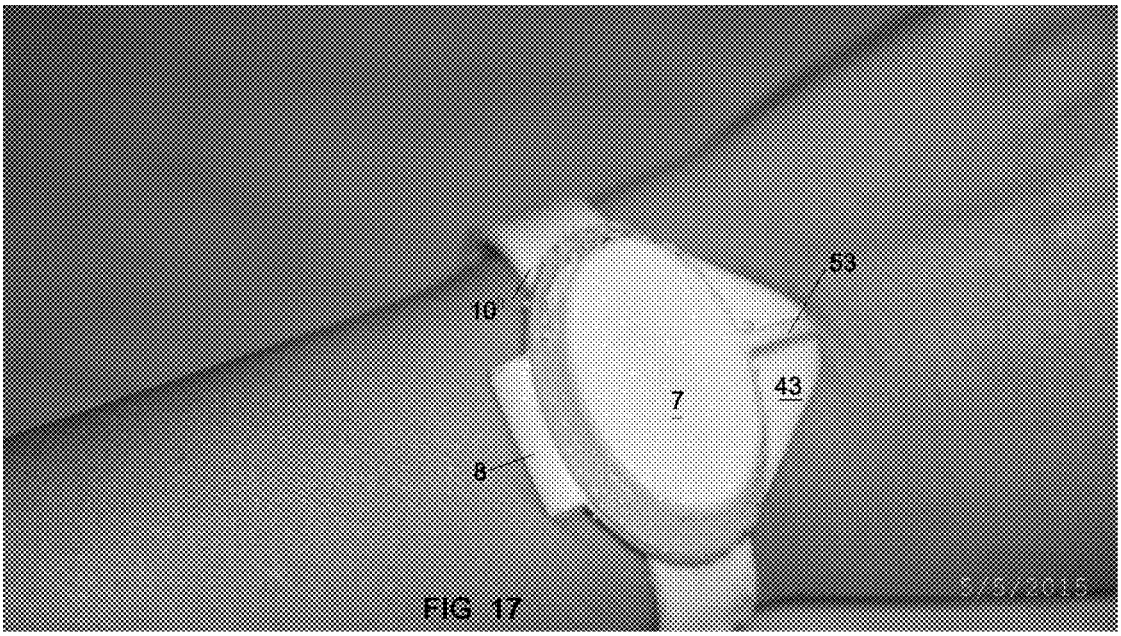
FIG. 17 is a perspective view of the top of the third embodiment closed on a user's wrist.
Figure 18:
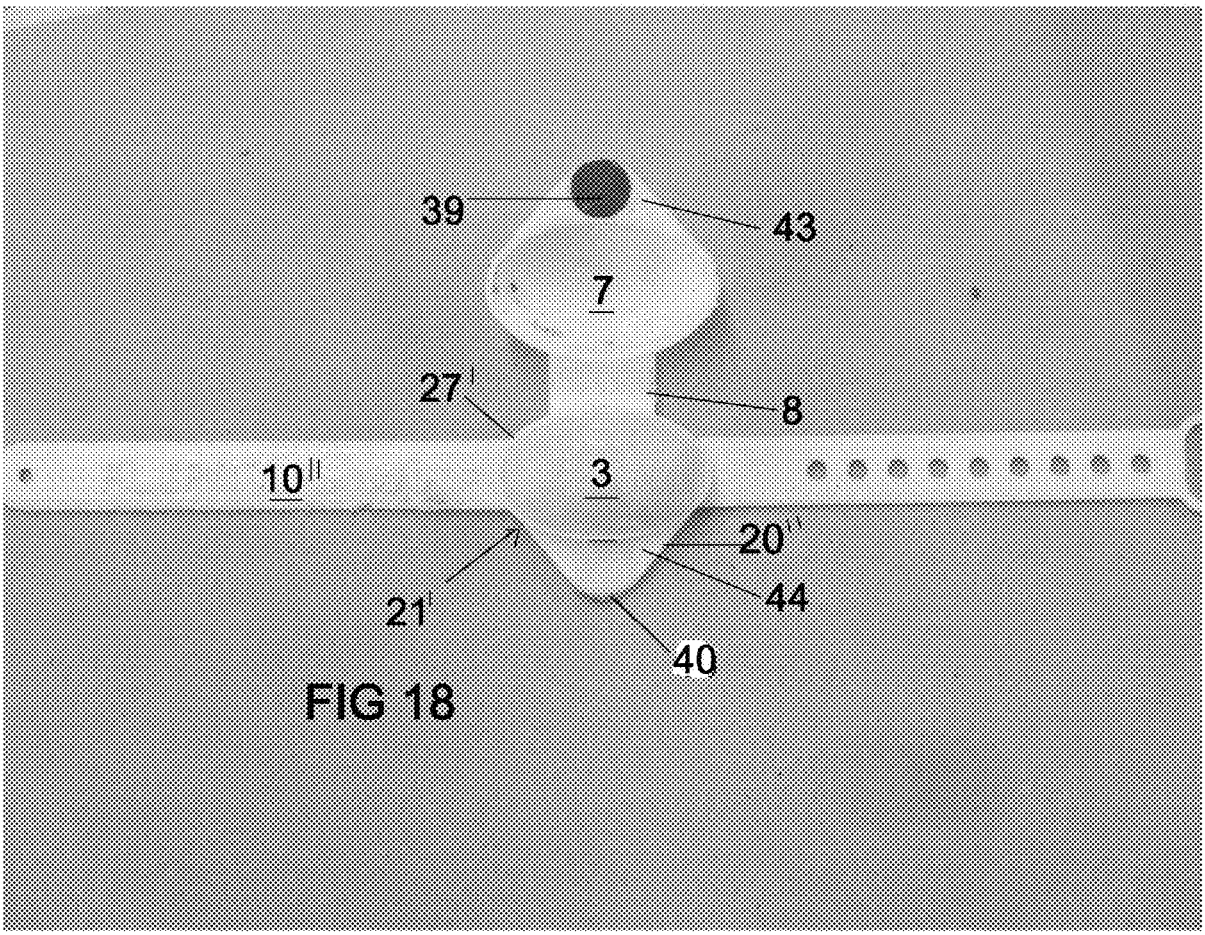
FIG. 18 is a perspective view of the top of the third embodiment in open position.
Figure 19:
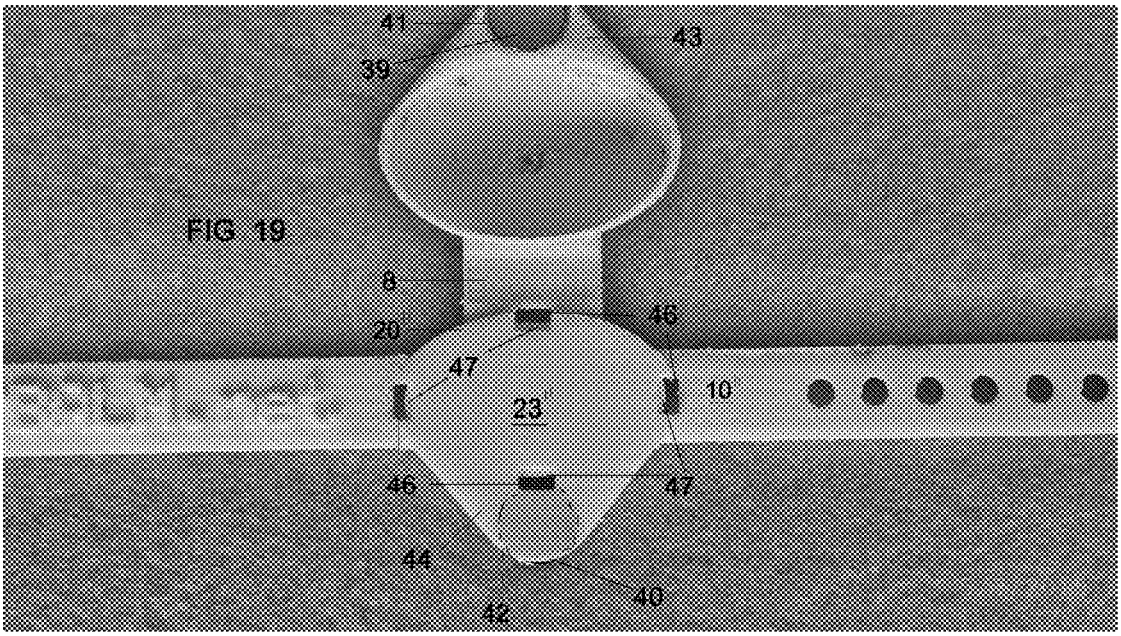
FIG. 19 is a perspective view of the top of the third embodiment with the refill removed.
Figure 20:
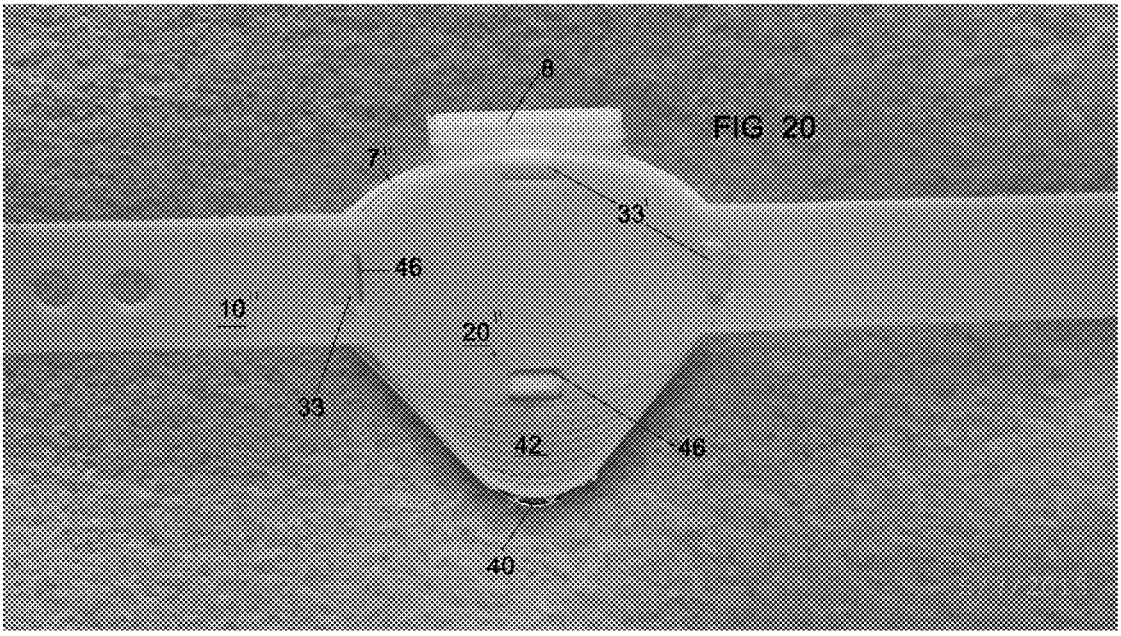
FIG. 20 is a perspective view of the underside of the third embodiment in closed position.
Figure 21:
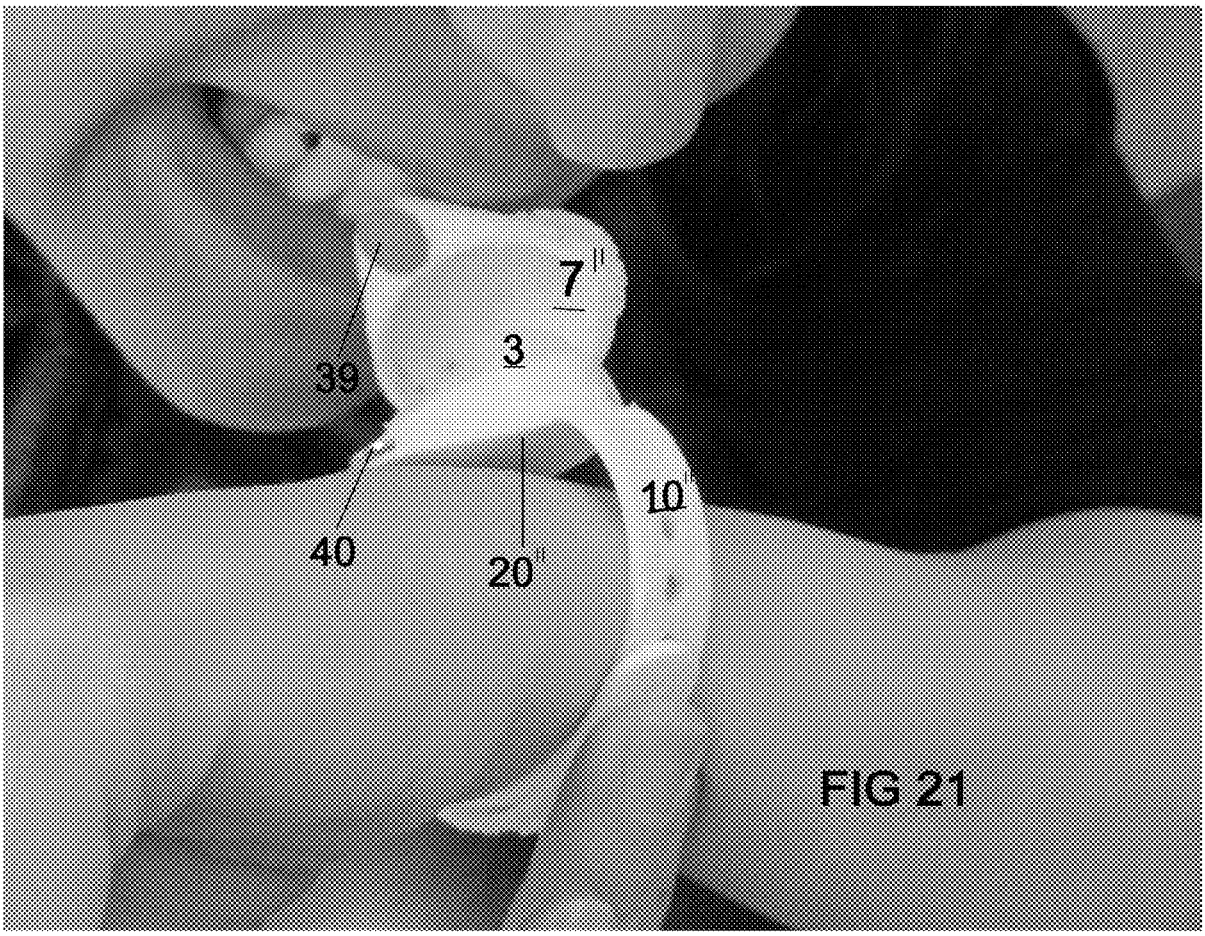
FIG. 21 is a perspective view of the third embodiment being opened by the user's teeth.
Figure 22:
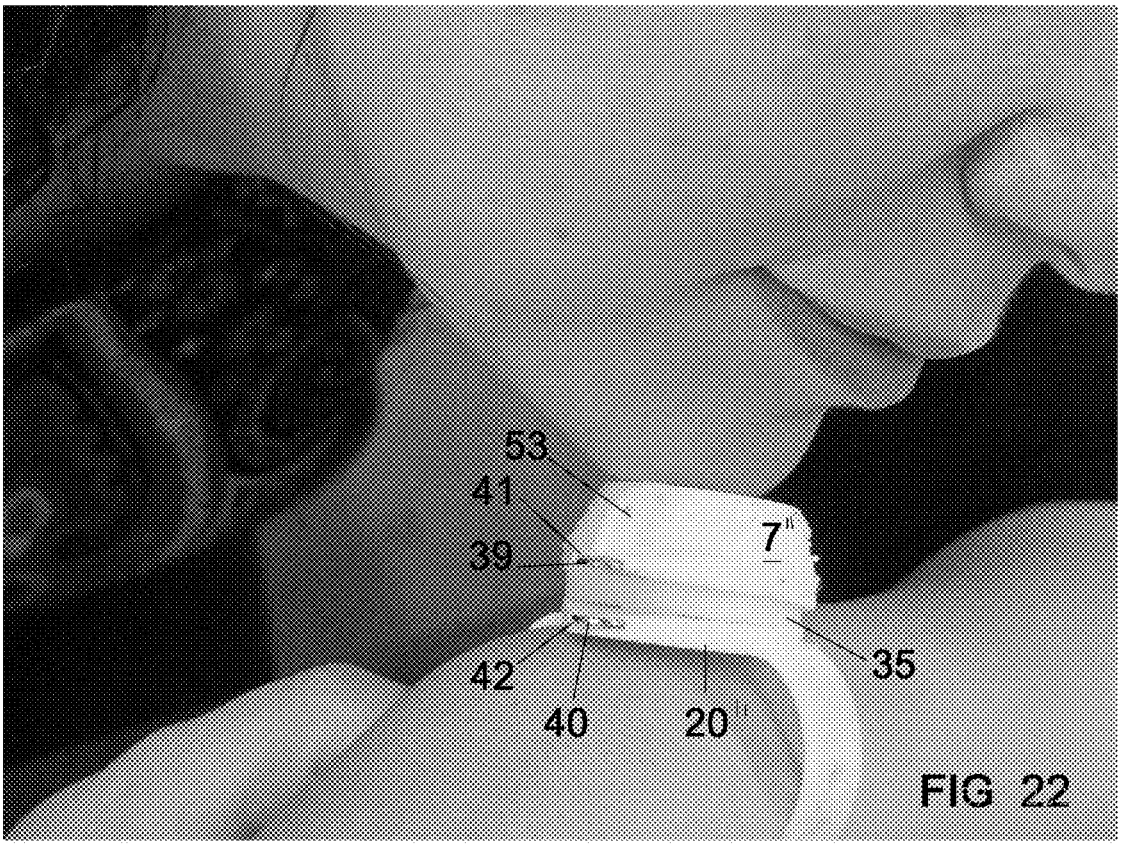
FIG. 22 is a perspective view of the embodiment being pushed closed by a user's chin.

The cover release tab is formed by a flange/fin 53 upstanding from the land 43 on the cover, (FIGS. 16 and 17).

Release of the legs and cartridge from the base member are effected by manually urging apart (outwards) the exposed lower end portions of the feet, their release being aided by flexure of the base.

Figure 23:
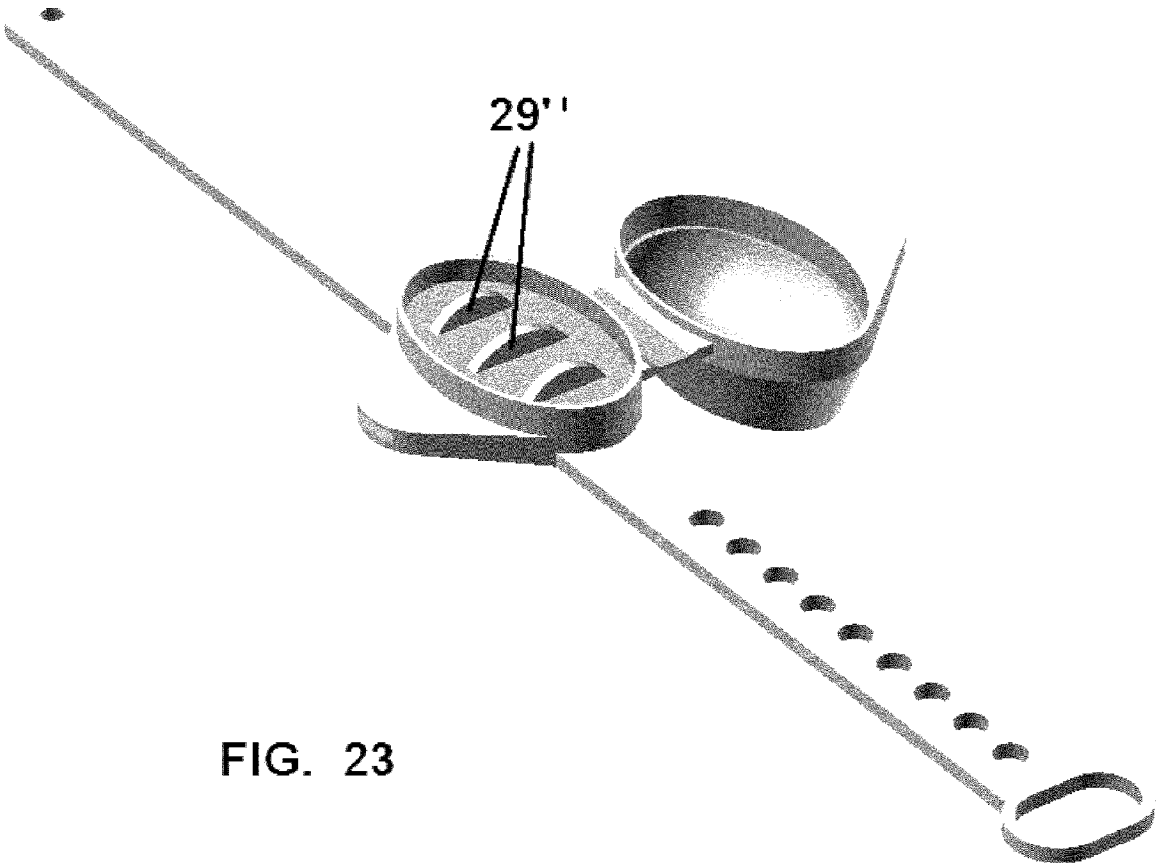
FIG. 23 is a perspective view of another, cartridge-free, embodiment integrally formed in one piece and ready to for directly filling with ointment by the manufacturer.

A fourth embodiment is a modification of the third embodiment as it does not employ a separate, removable, refill cartridge. Instead, the ointment anchoring fins 29' and retaining wall 35' are integrally formed with the base, as shown in FIG. 23.

It will be appreciated that references to the wrist include the forearm and that the applicator may, of course, be worn over protective outer garments.

The invention claimed is:

1. A hands-free, skin ointment applicator wearable on the wrist area of a user comprising:

a container having an open top;

a wristband connected to the container for securing, releasably, the container to a user's wrist area;

a reservoir of ointment retained in the container as a stable mound upstanding from the open top;

a recessed cover integrally joined to the container for hands-free movement between a closed position protectively receiving and enclosing the upstanding ointment mound in the recess and, an open position, exposing the upstanding ointment mound for application to the user's face by rubbing thereon, respectively;

means for retaining the cover engaging the open top in the closed position; and, a cover release tab extending laterally from the cover for gripping by the user's mouth to pull the cover away from the container top to the open position.

2. A skin ointment applicator according to claim 1 wherein guide means are provided on the applicator to maintain closing alignment of the cover with the open top during closing movement.

3. A skin ointment applicator according to claim 2 wherein the guide means comprises a web hinge integrally joining the cover to the container.

4. A skin ointment applicator according to claim 3 wherein the guide means and the means for retaining the cover engaging the open top comprises a pair of magnets aligned respectively, on the cover and container to be brought into proximity in the closed position.

5. A skin ointment applicator according to claim 4 wherein the magnets are retained in respective pockets formed at corresponding locations in the cover and in the base container, respectively.

6. A skin ointment applicator according to claim 2 wherein the guide means and the means for retaining the cover engaging the open top comprises a pair of magnets aligned respectively, on the cover and container to be brought into proximity in the closed position.

7. A skin ointment applicator according to claim 6 herein the magnets are retained in respective pockets formed at corresponding locations in the cover and in the base container, respectively.

8. A skin ointment applicator according to claim 1 wherein the wristband and the tab comprise at least one of a hook to loop material and a hook to hook material, adhesion by engagement of the tab and wristband providing means for retaining the cover in the closed position.

9. A skin ointment applicator according to claim 1 wherein, the container comprises a base and a refill comprising an ointment cartridge mountable, for manual, user release, on the base.

10. A skin ointment applicator according to claim 9 wherein the ointment cartridge comprises an ointment supporting platform having at least one ointment anchoring protuberance upstanding from an upper face thereof embedded in the ointment mound for retaining the mound on the platform during application by rubbing and, complementary mounting means on the base and cartridge for mounting the cartridge on the base, releasably.

11. A skin ointment applicator according to claim 10 wherein said at least one ointment anchoring protuberance comprises a plurality of segmental plates extending spaced apart in opposed relation, across a rubbing direction.

12. A skin ointment applicator according to claim 11 wherein:

the means for mounting the refill cartridge for manual release on the base comprises resilient latching legs with respective finger pieces at upper ends and latching feet at lower ends and pivotally connected intermediate their ends to the perimeter of the platform;

the base comprising a bottom wall and a retaining wall upstanding around a perimeter of the bottom wall and formed with vertical, latching leg receiving slots;

such that, with the latching legs aligned with the respective slots, the cartridge can be manually pushed down onto the base wall with the legs sliding down the slots until the latching feet engage a perimeter of the bottom wall of the base in a snap action and the cartridge can be released from the bottom wall of the base by manually squeezing the finger pieces together thereby to pivot the latching feet apart out of engagement with the bottom wall portion enabling the refill to be pulled manually out of the container base by the finger pieces over-riding any residual retention force from the feet, facilitated by forming the feet with a camming surface of engagement.

13. A skin ointment applicator according to claim 11 wherein:

latching legs depend from the perimeter of the cartridge platform and have latching feet at lower ends;

the base is formed with at least one through socket and foot catchment portions around a peripheral edge portion at locations aligned with respective latching feet, for latching engagement with outer catch surfaces on the respective feet so that release of the legs and cartridge are effected by disengaging the feet from the respective socket and catchment portions by manually urging the feet apart.

14. A skin ointment applicator according to claim 11 wherein:

latching legs depend from the perimeter of the cartridge platform and have latching feet at lower ends;

the base is formed with a series of through sockets at aligned locations; and a latching ledge juts out horizontally from an inner side wall of each socket intermediate the socket ends for latching engagement with outer catch surfaces on the respective legs so that release of the legs and cartridge are effected by disengaging the feet from the respective latching ledges by manually urging the feet apart.

15. A skin ointment applicator according to claim 9 wherein the wristband, base and cover are a single piece.

16. A skin ointment applicator according to claim 1 wherein the tab is formed by a land of the cover.

17. A skin ointment applicator according to claim 16 wherein the guide means and the means for retaining the cover engaging the open top comprises a pair of magnets aligned respectively, on the cover and container to be brought into proximity in the closed position; the magnets being retained in respective pockets formed at corresponding locations in the cover and in the base container, respectively, the land containing one of the magnet receiving pockets and the release tab comprising a fin for gripping by the user's mouth upstanding therefrom.

18. A skin ointment applicator according to claim 1 wherein the container, wristband, cover, retaining means and cover release tab form an integral, one-piece structure and the container comprises a bottom wall and at least one ointment anchoring protuberance upstands therefrom, embedded in the ointment mound for retaining the mound in the container during application by rubbing.

19. A skin ointment applicator according to claim 18 wherein said at least one ointment anchoring protuberance comprise a plurality of segmental plates extending spaced apart in opposed relation, transversely of a rubbing direction.

20. A hands-free, comestible holder wearable on the wrist area of a user comprising:

a container having an open top;

a wristband connected to the container for securing, releasably, the container to a user's wrist area;

a comestible retained in the container as a stable mound upstanding from the open top;

a recessed cover integrally joined to the container for hands-free movement between a closed position protectively receiving and enclosing the upstanding comestible mound in the recess and, an open position, exposing the upstanding mound for insertion in the user's mouth, respectively;

means for retaining the cover engaging the open top in the closed position; and, a cover release tab extending laterally from the cover for gripping by the user's mouth to pull the cover away from the container top to the open position.

21. A comestible holder according to claim 20 wherein the container comprises a bottom wall and at least one comestible anchoring protuberance upstanding therefrom, embedded in the comestible for retaining the comestible mound in the container during sucking/biting in the user's mouth.

22. A comestible holder according to claim 21 wherein said at least one comestible anchoring protuberance comprise a plurality of segmental plates extending spaced apart in opposed relation.

23. A comestible holder according to claim 21 wherein guide means are provided on the holder to maintain closing alignment of the cover with the open top during closing movement.

24. A comestible holder according to claim 21 wherein the guide means comprises a web hinge integrally joining the cover to the container.

* * * * *